US009561572B2

(12) United States Patent
Takeichi

(10) Patent No.: US 9,561,572 B2
(45) Date of Patent: Feb. 7, 2017

(54) EYEGLASS LENS PROCESSING APPARATUS AND PROCESSING CONTROL DATA GENERATING PROGRAM

(71) Applicant: NIDEK CO., LTD., Gamagori, Aichi (JP)

(72) Inventor: Kyoji Takeichi, Gamagori (JP)

(73) Assignee: NIDEK CO., LTD., Aichi (JP)

( * ) Notice: Subject to any disclaimer, the term of this patent is extended or adjusted under 35 U.S.C. 154(b) by 396 days.

(21) Appl. No.: 14/156,510

(22) Filed: Jan. 16, 2014

(65) Prior Publication Data

US 2014/0199916 A1 Jul. 17, 2014

(30) Foreign Application Priority Data

Jan. 17, 2013 (JP) ..... 2013-006447

(51) Int. Cl.
*G06F 19/00* (2011.01)
*B24B 9/14* (2006.01)
*B24B 51/00* (2006.01)

(52) U.S. Cl.
CPC ..... *B24B 9/148* (2013.01); *B24B 51/00* (2013.01)

(58) Field of Classification Search
CPC ..... B24B 9/148; B24B 51/00
USPC ..... 700/157–203
See application file for complete search history.

(56) References Cited

U.S. PATENT DOCUMENTS 4,781,452 A * 11/1988 Ace ..... B24B 9/148 351/159.74
6,062,947 A * 5/2000 Obayashi ..... B24B 9/14 451/255
6,099,383 A * 8/2000 Mizuno ..... B24B 9/148 451/256
7,167,771 B2 * 1/2007 Ito ..... G02C 7/021 351/200
7,533,453 B2 * 5/2009 Yancy ..... G06Q 30/02 29/10

(Continued)

FOREIGN PATENT DOCUMENTS

JP 6-74756 A 3/1994
JP 2003-295133 A 10/2003
JP 2006-142473 A 6/2006

OTHER PUBLICATIONS

Ebisawa, Yoshinobu. "Improved video-based eye-gaze detection method." Instrumentation and Measurement, IEEE Transactions on 47.4 (1998): pp. 948-955.*

(Continued)

*Primary Examiner* — Satish Rampuria
(74) *Attorney, Agent, or Firm* — Sughrue Mion, PLLC

(57) ABSTRACT

An eyeglass lens processing apparatus configured to form, on a peripheral edge of a lens, a bevel or a groove for fitting the lens to a frame of an eyeglass, includes: a data calculating unit for calculating data of the bevel or the groove to be formed on the peripheral edge of the lens based on frame shape data of the frame or demonstration lens shape data which is shape data of a demonstration lens having the bevel or the groove fitted to the shape of the frame; and a correction unit for approximating a front-side foot width, which is a width between a position of the bevel or the groove to be formed on the lens and a position of a front edge of the lens, to a target value by correcting the data of the bevel or the groove calculated by the data calculating unit.

9 Claims, 8 Drawing Sheets

(56) References Cited

U.S. PATENT DOCUMENTS

| | | | | |
|---|---|---|---|---|
| 8,295,961 | B2 * | 10/2012 | Daimaru | G02C 13/003 33/554 |
| 8,467,042 | B2 * | 6/2013 | Inoguchi | G01B 11/24 356/124 |
| 9,073,348 | B2 * | 7/2015 | Ookubo | B24B 13/0055 |
| 2003/0227690 | A1 * | 12/2003 | Jinbo | B24B 1/00 359/643 |
| 2005/0009455 | A1 | 1/2005 | Jinbo et al. | |
| 2009/0247051 | A1 * | 10/2009 | Obayashi | B24B 9/148 451/5 |

OTHER PUBLICATIONS

Hyde, Roderick A., et al. "Eyeglass: a very large aperture diffractive space telescope." Astronomical Telescopes and Instrumentation. International Society for Optics and Photonics, 2002, pp. 28-39.*

Vinger, Paul F., and Thomas A. Woods. "Prescription safety eyewear: impact studies of lens and frame failure." Journal—American Optometric Association 71.2 (2000): pp. 91-103.*

Park, Daechul, et al. "Lenticular stereoscopic imaging and displaying techniques with no special glasses." Image Processing, 1995. Proceedings., International Conference on. vol. 3. IEEE, 1995. pp. 137-140.*

Bruning, J. Herriot, et al. "Digital wavefront measuring interferometer for testing optical surfaces and lenses." Applied optics 13.11 (1974): 2693-2703.*

Toenshoff, Hans K., Ferdinand von Alvensleben, and Christian Kulik. "Advanced 3D-CAD interface for micromachining with excimer lasers." Design, Test, and Microfabrication of MEMS/MOEMS. International Society for Optics and Photonics, 1999. pp. 340-348.*

Communication dated Nov. 22, 2016 issued by the Japanese Patent Office in counterpart Japanese Patent Application No. 2013-006447.

* cited by examiner

EYEGLASS LENS PROCESSING APPARATUS AND PROCESSING CONTROL DATA GENERATING PROGRAM

CROSS REFERENCE TO RELATED APPLICATION

This application is based upon and claims the benefit of priority of Japanese Patent Application No. 2013-006447 filed on Jan. 17, 2013, the contents of which are incorporated herein by reference in its entirety.

BACKGROUND

The present disclosure relates to an eyeglass lens processing apparatus and a processing control data generating program for processing a peripheral edge of an eyeglass lens.

In the related art, various techniques have been proposed as a technique of calculating processing control data for forming a bevel or a groove in an eyeglass lens. For example, a bevel position setting device disclosed in JP-A-2006-142473 temporarily sets a position of a bevel by calculating a bevel curve based on a shape of an eyeglass frame. When the temporarily-set position of the bevel departs from an edge face of a lens, bevel data is calculated by changing the position of the bevel within an edge thickness. A technique of setting a position of a bevel or a groove to positions obtained by dividing the edge thickness at a predetermined ratio is also disclosed.

SUMMARY

When data of a bevel or a groove is calculated based on a shape (for example, an edge thickness) of a lens, appearance in a state where the lens is fitted to a frame is improved. However, a groove or a protrusion formed in the frame may not match the bevel or the groove formed in the lens and thus the lens may not be fitted to the frame. On the other hand, when the data of the bevel or the groove is calculated to match the shape of the frame, the lens is easily fit to the frame, but the appearance of an eyeglass may become worse. The bevel position setting device described in JP-A-2006-142473 can change the position of the bevel temporarily set based on the shape of the frame within the edge thickness, but have a difficulty in changing the position of the bevel such an extent to improve the appearance of the eyeglass.

An object of the present disclosure is to provide an eyeglass lens processing apparatus and a processing control data generating program which can improve appearance of an eyeglass and can easily fit a lens to a frame.

An aspect of the present disclosure provides the following arrangement:

An eyeglass lens processing apparatus comprising:

a processing unit configured to form, on a peripheral edge of a lens, a bevel or a groove for fitting the lens to a frame of an eyeglass;

a processor; and memory storing computer readable instructions, when executed by the processor, causing the eyeglass lens processing apparatus to:

calculate data of the bevel or the groove to be formed on the peripheral edge of the lens based on frame shape data of the frame or demonstration lens shape data which is shape data of a demonstration lens having the bevel or the groove fitted to the shape of the frame; and approximate a front-side foot width, which is a width between a position of the bevel or the groove to be formed on the lens and a position of a front edge of the lens, to a target value by correcting the calculated data of the bevel or the groove.

According to the aspects of the present disclosure, the eyeglass lens processing apparatus can improve appearance of an eyeglass and can easily fit a lens to a frame.

DESCRIPTION OF EXEMPLARY EMBODIMENTS

Figure 1:
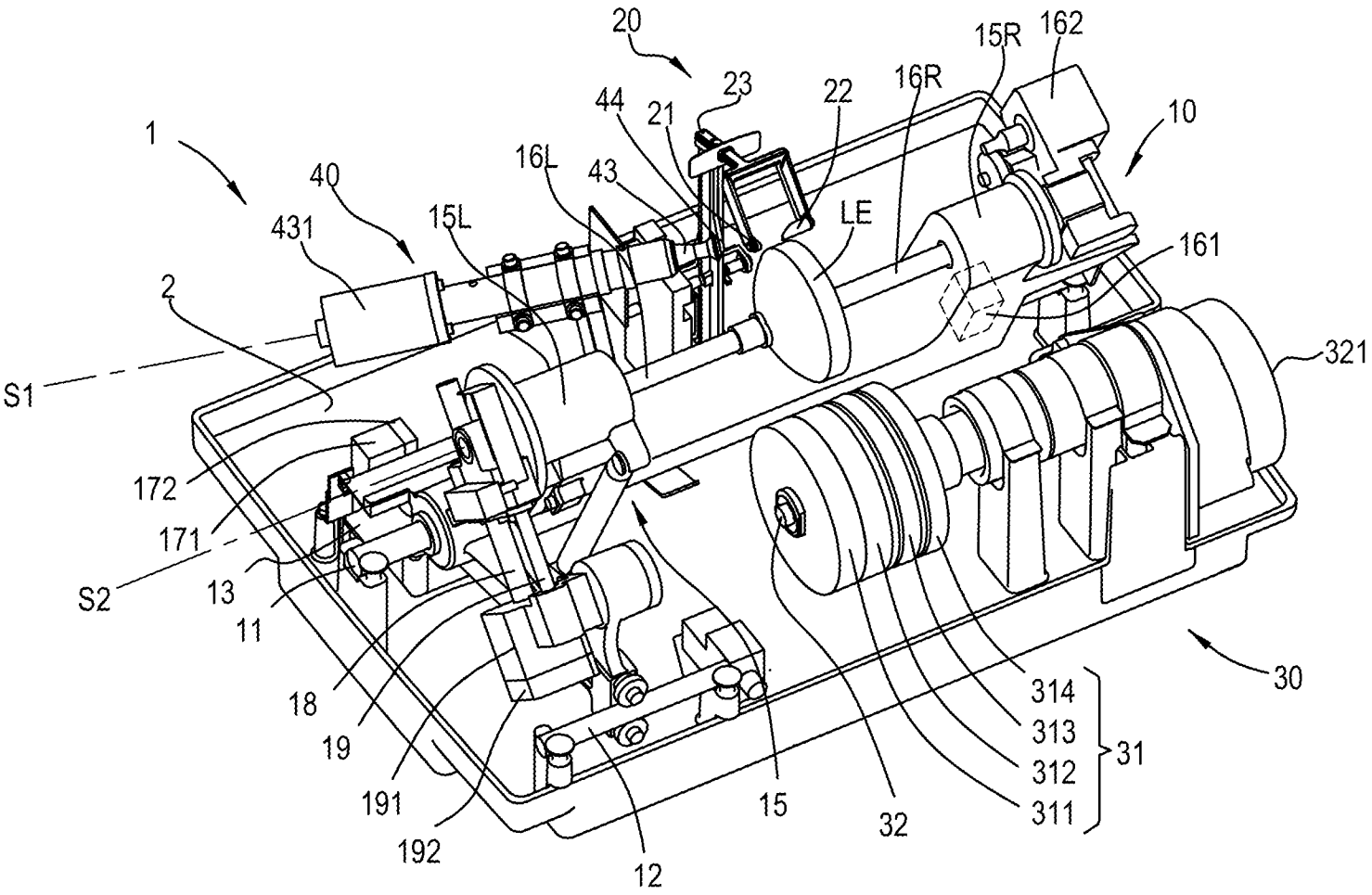
FIG. 1 is a diagram schematically illustrating a configuration of a processing mechanism of an eyeglass lens processing apparatus 1.

Hereinafter, an exemplary embodiment will be described with reference to the accompanying drawings. The art according to the present disclosure can be applied to form a bevel or a groove on a peripheral edge of a lens LE and an example where a bevel is formed will be described in this embodiment. As illustrated in FIG. 1, an eyeglass lens processing apparatus (lens edger) 1 according to this embodiment approximately includes a lens holding unit 10, a lens shape measuring unit 20, a first lens processing unit 30, and a second lens processing unit 40. The eyeglass lens processing apparatus 1 chucks the lens LE with two lens chuck shafts 16L and 16R of the lens holding unit 10. The eyeglass lens processing apparatus 1 processes the lens LE by changing the relative positional relationship between the first lens processing unit 30 and the second lens processing unit 40 and the lens LE chucked with the lens chuck shafts 16L and 16R.

In the following description, a direction in which an inter-shaft distance between the lens chuck shafts 16L and 16R and a first processing tool rotating shaft 32 of the first lens processing unit 30 varies is defined as an X direction. A direction in which the lens chuck shafts 16L and 16R extend is defined as a Z direction. A Y direction is substantially the up-and-down direction of the eyeglass lens processing apparatus 1. The right-tilt lower side, the left-tilt upper side, the right-tilt upper side, and the left-tilt lower side in FIG. 1 are defined as the front side, the rear side, the right side, and the left side of the eyeglass lens processing apparatus 1, respectively.

<Lens Holding Unit>

The lens holding unit 10 includes shafts 11 and 12, a Z-axis moving support base 13, and a carriage 15. The shaft 11 is fixed to the central part in the front-and-rear direction of a base 2 in the eyeglass lens processing apparatus 1. The shaft 12 is fixed to the front-left side of the base 2. The two shafts 11 and 12 both extend in the Z axis direction (that is, a direction parallel to the lens chuck shafts 16L and 16R). The Z-axis moving base 13 is supported by the shafts 11 and 12 so as to be movable in the Z axis direction. The carriage 15 is mounted on the Z-axis moving base 13.

The carriage 15 includes a left arm 15L on the left side and a right arm 15R on the right side. The left arm 15L rotationally holds the lens chuck shaft 16L. The right arm 15R rotationally holds the lens chuck shaft 16R. The two lens chuck shafts 16L and 16R are located on the same axis. The right lens chuck shaft 16R moves in the Z axis direction by a chucking motor 161 mounted on the right arm 15R. The eyeglass lens processing apparatus 1 chucks the lens LE between the two lens chuck shafts 16L and 16R by causing the right lens chuck shaft 16R to move to the left. The right arm 15R is provided with a lens rotating motor 162 causing the two lens chuck shafts 16L and 16R to rotate. When the lens rotating motor 162 rotates, the two lens chuck shafts 16L and 16R rotate about an axis in synchronization with each other.

A Z-axis moving motor 171 is mounted in the vicinity of the left end of the shaft 11. The rear part of the Z-axis moving base 13 is provided with a ball screw (not illustrated) extending in the Z axis direction in parallel to the shaft 11. When the Z-axis moving motor 171 rotates, the ball screw rotates. As a result, the Z-axis moving base 13 and the carriage 15 move linearly in the Z axis direction. The Z-axis moving motor 171 is provided with an encoder 172. The encoder 172 detects movement in the Z direction of the carriage 15 by detecting the rotation of the Z-axis moving motor 171.

A guide shaft 18 and a ball screw 19 are disposed in parallel between the Z-axis moving base 13 and the left arm 15L of the carriage 15. An X-axis moving motor 191 is disposed in the vicinity of the front end of the Z-axis moving base 13. When the X-axis moving motor 191 rotates, the ball screw 19 rotates. As a result, the carriage 15 rotates about the shaft 11. The eyeglass lens processing apparatus 1 changes the relative positional relationship between the first lens processing unit 30 and the second lens processing unit 40 and the lens LE chucked with the lens chuck shafts 16L and 16R by causing the carriage 15 to rotate. That is, the eyeglass lens processing apparatus 1 causes the first lens processing unit 30 and the second lens processing unit 40 to move in the X direction relative to the lens LE by driving the X-axis moving motor 191. The eyeglass lens processing apparatus 1 may perform a processing operation by causing the first lens processing unit 30 and the second lens processing unit 40 to move. That is, the eyeglass lens processing apparatus 1 has only to have a configuration for causing the first lens processing unit 30 and the second lens processing unit 40 to move relative to the lens LE. The X-axis moving motor 191 is provided with an encoder 192. The encoder 192 detects movement in the X direction of the carriage 15 by detecting the rotation of the X-axis moving motor 191.

<Lens Shape Measuring Unit>

The lens shape measuring unit 20 is disposed on the rear side of the carriage 15. The lens shape measuring unit 20 includes a tracing stylus 21 coming in contact with the front surface of the lens LE and a tracing stylus 22 coming in contact with the rear surface of the lens LE. The tracing styluses 21 and 22 are held by an arm 23 movable in the Z direction. The lens shape measuring unit 20 includes a sensor 231 (see FIG. 3) that detects a position of the arm 23 in the Z direction. When measuring a lens shape, the eyeglass lens processing apparatus 1 causes the lens chuck shafts 16L and 16R to rotate and controls movements in the X direction of the lens chuck shafts 16L and 16R based on a target lens shape. As a result, the positions in the Z direction of the front surface and the rear surface of the lens corresponding to a target lens shape are detected by the sensor 231. In the eyeglass lens processing apparatus 1 according to this embodiment, the lens shape is measured using also the control of movement in the Z direction of the lens chuck shafts 16L and 16R.

<First Lens Processing Unit>

The first lens processing unit 30 is disposed on the front side of the carriage 15. The first lens processing unit 30 includes a first processing tool 31, a first processing tool rotating shaft 32, and a first processing tool rotating motor 321. The first processing tool 31 includes a glass roughening grindstone 311, a finishing grindstone 312, a polishing-finishing grindstone 313, and a plastic roughening grindstone 314. A V groove (bevel groove) VG for forming a bevel in the lens LE and a flat processing surface are formed in the finishing grindstone 312. The first processing tool rotating shaft 32 extends in the Z axis direction and coaxially fixes plural grindstones of the first processing tool 31 having a substantially disk-like shape. The first processing tool rotating motor 321 is connected to the right end of the first processing tool rotating shaft 32. When the first processing tool rotating motor 321 rotates, the first processing tool rotating shaft 32 and the first processing tool 31 rotate about an axis. The eyeglass lens processing apparatus 1 processes the peripheral edge of the lens LE by bringing the lens LE into contact with the first processing tool 31.

<Second Lens Processing Unit>

The second lens processing unit 40 is disposed on the rear side of the carriage 15. The second lens processing unit 40 is fixed and disposed in parallel to the lens shape measuring unit 20 outside the moving range of the lens shape measuring unit 20.

Figure 2:
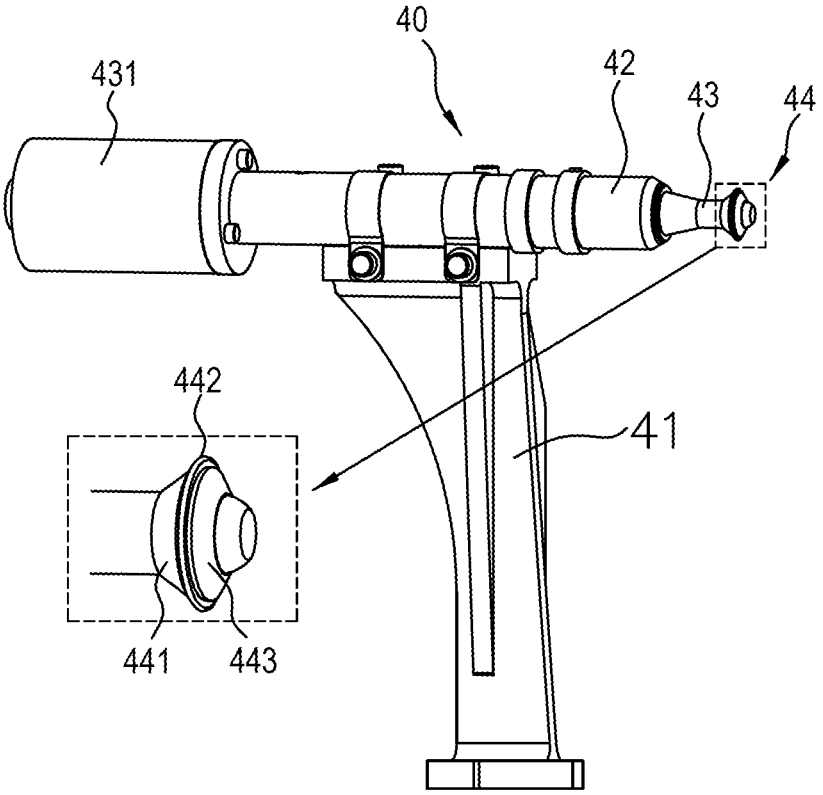
FIG. 2 is a front view of a second lens processing unit 40.

As illustrated in FIG. 2, the second lens processing unit 40 includes a support base block 41, a holding member 42, a second processing tool rotating shaft 43, a second processing tool 44, and a second processing tool rotating motor 431. The support base block 41 is fixed to the base 2 (see FIG. 1) and extends upward from the base 2. The holding member 42 is fixed to the upper end of the support base block 41 and rotationally holds the second processing tool rotating shaft 43. The second processing tool 44 includes a chamfering grindstone 441 for a rear lens surface, a grooving tool 442, and a chamfering grindstone 443 for a front lens surface. In this embodiment, the chamfering grindstones 441 and 443 and the grooving tool 442 are integrally formed but may be separately formed.

The maximum diameter of the chambering grindstones 441 and 443 is smaller (about 20 mm) than the diameter of the grooving tool 442. The chambering grindstones 441 and 443 have a taper shape in which the diameter decreases as the distance from the grooving tool 442 increases. The eyeglass lens processing apparatus 1 chamfers the edge corner of the lens LE by bringing the lens LE into contact with the chambering grindstones 441 and 443.

A portion of the grooving tool 442 coming in contact with the lens LE has an annular shape. Therefore, the eyeglass lens processing apparatus 1 can form a groove in the peripheral edge of the lens by bringing the grooving tool 442 into contact with the lens LE while it is caused to rotate. In this embodiment, the grooving tool 442 is formed as a unified body with the chamfering grindstones 441 and 443. However, a grooving tool 442 having a disk-like shape may be independently used. In this embodiment, a grindstone is used as the grooving tool 442. However, the configuration of the grooving tool 442 may be changed. For example, a cutter having a substantially disk-like shape or a substantially annular shape and having teeth on the outer periphery may be used as the grooving tool 442.

In this embodiment, the axial line direction of the second processing tool rotating shaft 43 is fixed. Specifically, as illustrated in FIG. 1, the axial line direction S1 of the second processing tool rotating shaft 43 is inclined by a predetermined angle (15 degrees in this embodiment) relative to the axial line direction S2 of the lens chuck shafts 16L and 16R. Since the axial line direction of the second processing tool rotating shaft 43 is fixed, the relative angle of the grooving tool 442 to the lens LE and the lens chuck shafts 16L and 16R is fixed. By removing the mechanism for changing the axial line direction of the second processing tool rotating shaft 43, the structure of the eyeglass lens processing apparatus 1 is simplified. Therefore, it is possible to easily reduce the size and the cost of the apparatus. Here, even when the axial line direction of the second processing tool rotating shaft 43 is changed, the technique described in the present disclosure as an example can be applied.

<Electrical Configuration>

Figure 3:
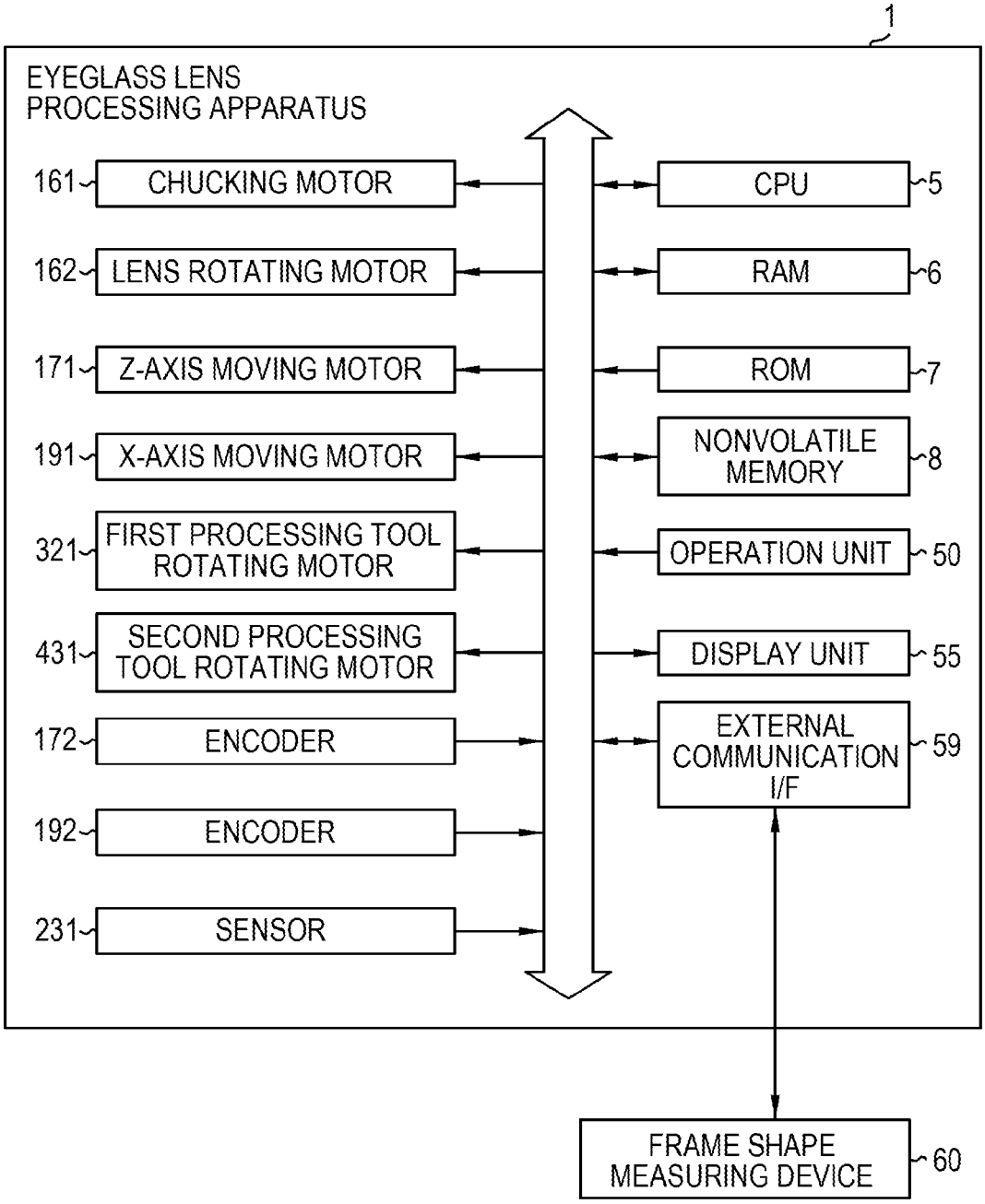
FIG. 3 is a block diagram illustrating an electrical configuration of the eyeglass lens processing apparatus 1.

The electrical configuration of the eyeglass lens processing apparatus 1 will be described below with reference to FIG. 3. The eyeglass lens processing apparatus 1 includes a CPU 5 which is a processor taking charge of control of the eyeglass lens processing apparatus 1. The CPU 5 is connected to a RAM 6, a ROM 7, a nonvolatile memory 8, an operation unit 50, a display unit 55, and an external communication I/F 59 via a bus. Various devices (the chucking motor 161, the lens rotating motor 162, the Z-axis moving motor 171, the X-axis moving motor 191, the first processing tool rotating motor 321, the second processing tool rotating motor 431, the encoder 172, the encoder 192, and the sensor 231) such as the above-mentioned motors are connected to the CPU 5 via a bus.

The RAM 6 temporarily stores a variety of information. The ROM 7 stores various programs and initial values. The nonvolatile memory 73 is a readable-writable storage medium (for example, a flash ROM and a hard disk drive) which can maintain stored details even when a supply of power thereto is stopped. The nonvolatile memory 73 stores control programs (for example, a processing control data generating program for controlling a bevel data generating process illustrated in FIGS. 4 to 7) for controlling the operation of the eyeglass lens processing apparatus. The operation unit 50 is disposed to receive an input of various instructions from an operator. For example, operation buttons and a touch panel disposed on the surface of the display unit 55 can be used as the operation unit 50. The display unit 55 displays a variety of information such as a shape of a lens LE and a shape of a frame. The external communication I/F 59 couples the eyeglass lens processing apparatus 1 to an external device.

In this embodiment, the eyeglass lens processing apparatus 1 is coupled to a frame shape measuring device 60 (for example, a device disclosed in JP-A-4-93164). The frame shape measuring device 60 measures a shape of a frame (specifically, shapes of grooves formed in the left and right rims on which a lens LE will be mounted). When bevels are formed in the lens LE so as to match the shape of the grooves, the bevels are fitted into the grooves of the rims to fix the lens LE. The eyeglass lens processing apparatus 1 acquires data (hereinafter, referred to as "frame shape data") indicating the frame shape from the frame shape measuring device 60. The eyeglass lens processing apparatus 1 may acquire the frame shape data using another method. For example, the eyeglass lens processing apparatus 1 may include a frame shape measuring unit that measures the frame shape. In this case, the eyeglass lens processing apparatus 1 may acquire the frame shape data by measuring the frame shape by the use of the frame shape measuring unit. The eyeglass lens processing apparatus 1 may acquire the frame shape data via a network such as Internet. The frame shape data may be acquired from a personal computer (hereinafter, referred to as a "PC") or the like. The frame shape data may be acquired by causing an operator to operate the operation unit 50 and to input the frame shape.

<Bevel Data Generating Process>

A bevel data generating process which is performed by the CPU 5 of the eyeglass lens processing apparatus 1 will be described with reference to FIGS. 4 to 7. The bevel data is data for controlling an operation of the eyeglass lens processing apparatus 1 of forming a bevel in a peripheral edge of a lens LE. The bevel is a ridge portion for fitting a lens LE to a groove of a frame. In the bevel data generating process according to this embodiment, the bevel data is generated based on the frame shape data and the edge position of the lens LE on the front surface side.

As described above, the nonvolatile memory 8 of the eyeglass lens processing apparatus 1 stores a processing control data generating program for controlling the bevel data generating process. When an instruction to generate the bevel data is input from the operation unit 50 or an external device, the CPU 5 performs the bevel data generating process illustrated in FIG. 4 in accordance with the processing control data generating program.

Figure 4:
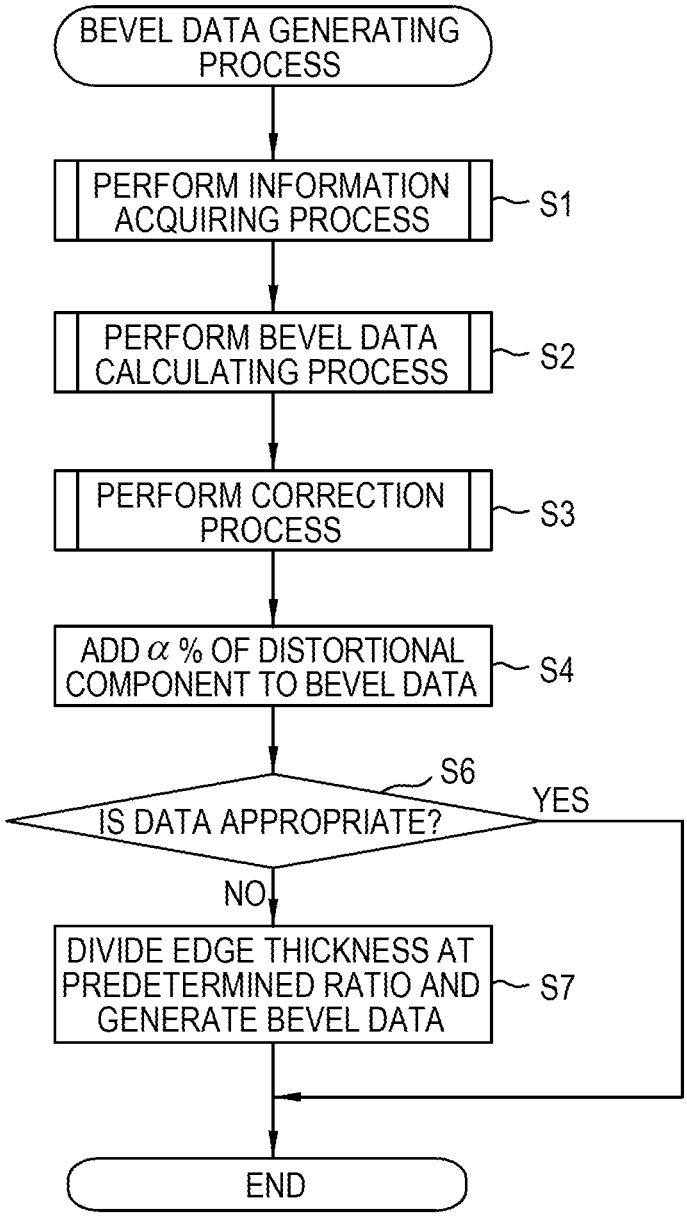
FIG. 4 is a flowchart illustrating a process flow of a bevel data generating process which is performed by a processor of the eyeglass lens processing apparatus 1.

As illustrated in FIG. 4, when the bevel data generating process is started, an information acquiring process is performed (S1). In the information acquiring process, a variety of information necessary for generating the bevel data are acquired.

Figure 5:
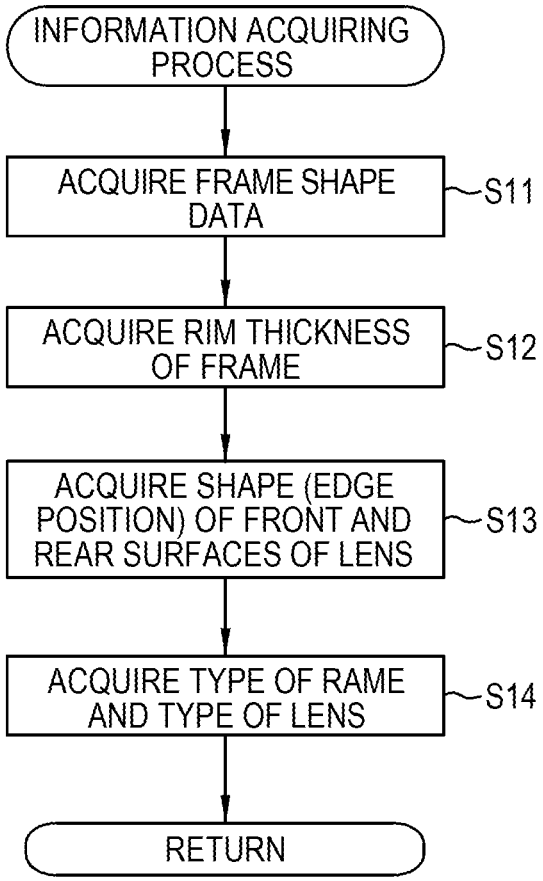
FIG. 5 is a flowchart illustrating a process flow of an information acquiring process which included in the bevel data generating process.

As illustrated in FIG. 5, in the information acquiring process, the frame shape data is acquired (S11). As described above, in this embodiment, the frame shape data is generated by measuring (tracing) the shape of the groove formed on the left and right rims of the frame by the use of the frame shape measuring device 60 (see FIG. 3). The CPU 5 acquires the frame shape data from the frame shape measuring device 60. However, the CPU 5 may acquire the frame shape data using another method.

The frame shape data can be any data as long as at least a spherical component of the groove of the frame can be obtained from the data. In this embodiment, three-dimensional data or spherical component data itself (that is, frame curve) of the groove of the frame is acquired as the frame shape data. When the three-dimensional data can be acquired, the spherical component can be separated from the acquired three-dimensional data. In the three-dimensional data of this embodiment, the positions in the X direction and the Y direction are expressed in a two-dimensional polar coordinate system by a radius r and a declination θ, and the position in the Z direction is expressed by a Z coordinate value. That is, the three-dimensional data of this embodiment is expressed as (frn, fθn, fZn) (where n is 1, 2, 3, . . . , N) in a cylindrical coordinate system. The spherical component data is expressed by a curve value (diopter) of a curve of the groove of the frame or a spherical surface including a curve approximating thereto. Here, the data format of the frame shape data can be appropriately changed. For example, the frame shape data expressed in a three-dimensional orthogonal coordinate system or a three-dimensional polar coordinate system may be acquired.

Subsequently, the thicknesses of the left and right rims (hereinafter, referred to as "rim thicknesses") of the frame are acquired (S12). In this embodiment, the value of a rim thickness input to the operation unit 50 by the operator is acquired. However, the rim thickness acquiring method can be also changed. For example, a function of measuring a rim thickness may be provided to the frame shape measuring device 60 and the CPU 5 may acquire the rim thickness measured by the frame shape measuring device 60. When the rim thickness is not constant over the entire circumference, the CPU 5 acquires the average of the rim thicknesses over the entire circumference. Therefore, the CPU 5 can generate appropriate bevel data corresponding to the rim thickness of the frame. However, the CPU 5 may acquire the minimum value, the maximum value, or the like of the rim thickness. The operator may appropriately correct the value of the rim thickness. The following process may be performed using the fixed value of the rim thickness. For example, the fixed value of the rim thickness may be set to 2 mm for a metal frame, the fixed value of the rim thickness may be set to 4 mm for a plastic frame, and any one fixed value may be employed depending on the material of the frame.

Subsequently, data (hereinafter, referred to as "lens shape data") indicating the shapes of the front surface and the rear surface of the lens LE is acquired (S13). As a result, an edge position of the front surface and an edge position of the rear surface in the lens LE are acquired. The edge position is a position (trace) of a pair of front and rear ridge portions at the edge of the lens LE. In this embodiment, the eyeglass lens processing apparatus 1 drives the lens rotating motor 162 and the X-axis moving motor 191 based on target lens shape data (two-dimensional polar coordinate data) in a state where the tracing stylus 21 of the lens shape measuring unit 20 (see FIG. 1) is in contact with the front surface of the lens LE. As a result, data indicating the edge position of the lens LE on the front surface side is acquired. When data indicating the edge position of the rear surface is acquired, the eyeglass lens processing apparatus 1 brings the tracing stylus 22 into contact with the rear surface of the lens LE. The method of acquiring data of the edge position can be changed. For example, the CPU 5 may acquire the data of the edge position measured by another device via a network or the like.

Subsequently, type information of the frame and type information of the lens LE are acquired (S14). Specifically, as the material of the frame becomes harder, the difference between the shape of the groove of the frame and the shape of the bevel has a large influence and the lens LE is not fitted to the frame well. The shape of the bevel with which the appearance of an eyeglass is improved varies depending on the shape of the lens LE. Therefore, in this embodiment, the CPU 5 acquires material information (a metal frame or a plastic frame) of the frame and shape information (a minus lens or a plus lens) of the lens LE. The information acquiring method can be appropriately selected. For example, the CPU 5 can acquire the type information of the frame and the type information of the lens LE input by causing the operator to operate the operation unit 50. The type information of the lens LE may be acquired from the shapes of the front surface and the rear surface of the lens LE. The CPU 5 corrects the bevel data based on the material of the frame and the shape of the lens LE in a correction process (see FIG. 7) to be described later. Thereafter, the process flow returns to the bevel data generating process.

As illustrated in FIG. 4, when the information acquiring process (S1) ends, the bevel data calculating process is performed (S2). In the bevel data calculating process, data of a bevel matching with the shape of the groove of the frame is calculated as temporary bevel data based on the frame shape data acquired in the information acquiring process.

Figure 6:
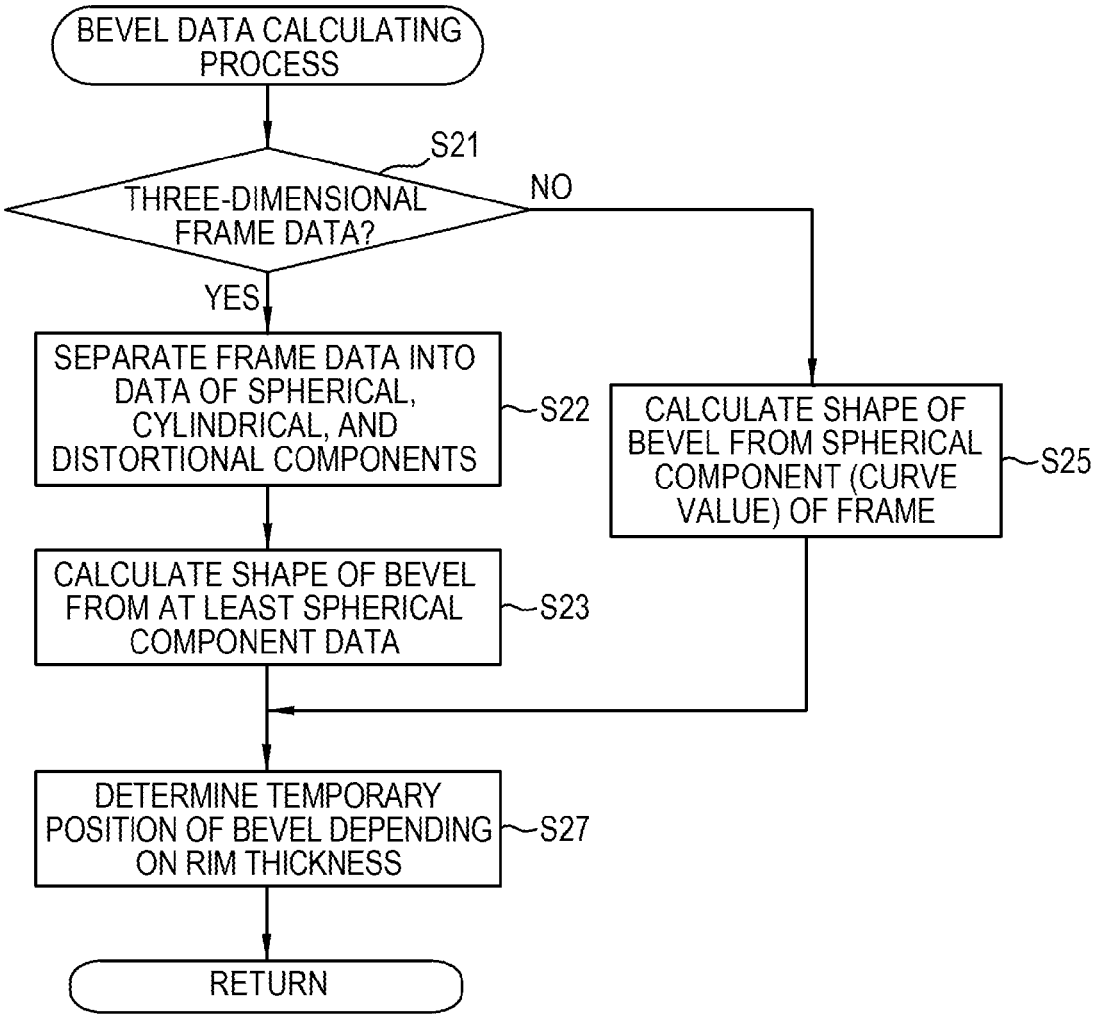
FIG. 6 is a flowchart illustrating a process flow of a bevel data calculating process which is included in the bevel data generating process.

As illustrated in FIG. 6, when the bevel data calculating process is started, it is determined whether the acquired frame shape data is three-dimensional data (S21). As described above, in this embodiment, three-dimensional data or spherical component data of the groove of the frame is acquired. When the three-dimensional frame shape data is acquired (YES in S21), spherical component data, cylindrical component data, and distortional component data are separated from the acquired three-dimensional data (S22). In this process, first, the CPU 5 extracts the spherical component from the three-dimensional shape of the groove and generates the spherical component data. Subsequently, the CPU 5 extracts the cylindrical component from the shape of the groove from which the spherical component has been extracted and generates the cylindrical component data. The remaining shape data from after the spherical component and the cylindrical component have been extracted from the shape of the groove is the distortional component data.

A temporary shape of the bevel to be formed in the lens LE is calculated based on at least the spherical component data out of the spherical component data, the cylindrical component data, and the distortional component data which have been separated (S23). In this embodiment, the temporary shape of the bevel is calculated based on the spherical component data and the cylindrical component data. Therefore, when a lot of cylindrical component is included in the shape of the groove of the frame, the CPU 5 can calculate the temporary shape of the bevel suitable for the shape of the frame. However, the CPU 5 may calculate the temporary shape of the bevel using only the spherical component data. The temporary shape of the bevel may be calculated using all of the spherical component data, the cylindrical component data, and the distortional component data. In this case, the process of S4 (see FIG. 4) to be described later is not necessary. When the distortional component data is used, all the distortional component does not need to be reflected in the shape of the bevel.

When the acquired frame shape data is the spherical component data (NO in S21), the temporary shape of the bevel is calculated based on the acquired spherical component data (curve value) and two-dimensional target lens shape data (S25). Then, the temporary position of the bevel is determined (S27). That is, temporary bevel data is calculated through the processes of S23, S25, and S27. The process flow returns to the bevel data generating process. In the process of S27 in this embodiment, the CPU 5 calculates the edge thickness of the lens LE from the edge positions of the front surface and the rear surface of the lens acquired in S13 (see FIG. 5). A portion A in which the edge thickness is the smallest is specified from the calculated edge thickness. When the rim thickness of the frame acquired in S12 (see FIG. 5) is defined W, a distance W/2 corresponding to half the rim thickness W is calculated. The CPU 5 determines a temporary position of the bevel of which the shape is calculated in S23 or S25 so that the bevel apex is located in W/2 from the front surface of the lens LE in the portion A. In this case, when the temporarily-arranged bevel is formed in the lens LE without any change, the front surface of the lens and the front surface of the rim of the frame match with each other in the portion A. Therefore, the eyeglass lens processing apparatus 1 can easily form the bevel of which the appearance is good. Here, the method of determining the temporary position of the bevel can be appropriately changed. For example, in a specific portion of the lens LE, the temporary position of the bevel may be determined so as to pass through a position which is obtained by dividing the edge thickness at a predetermined ratio.

Figure 8:
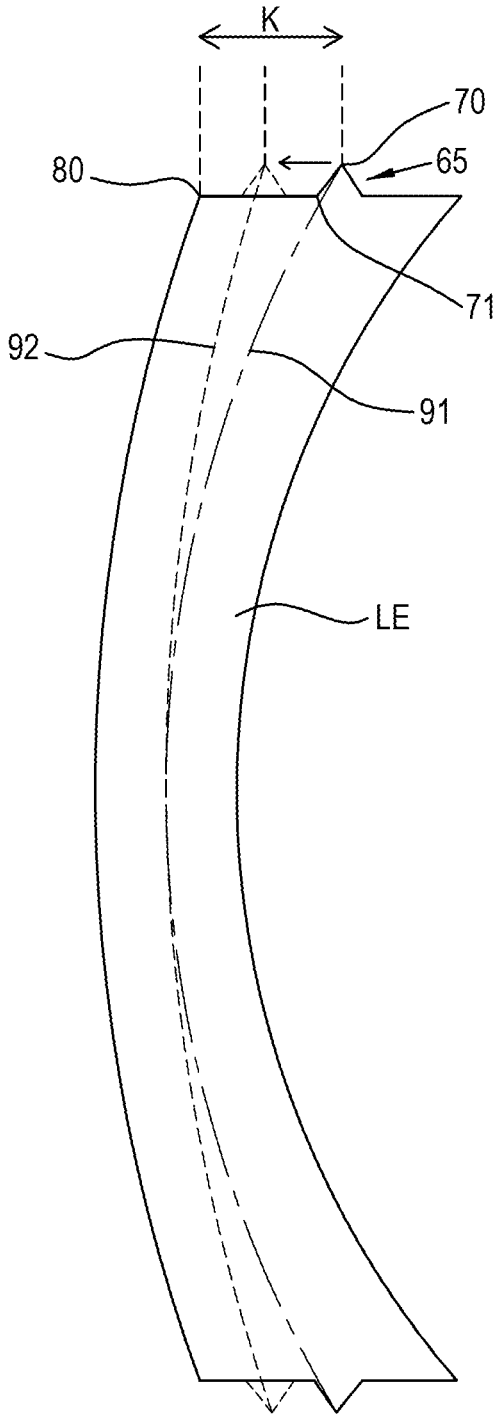
FIG. 8 is a diagram schematically illustrating a temporary position 91 of a bevel and a corrected position of the bevel 65.

As illustrated in FIG. 4, when the bevel data calculating process (S2) ends, the correction process is performed (S3). In the correction process, the temporarily-calculated bevel data is corrected so as to reduce a width (hereinafter, referred to as a "front-side foot width") between the position of the bevel to be formed in the lens LE and the edge position on the front surface of the lens LE. As illustrated in FIG. 8, the CPU 5 may set the width between the apex 70 of the bevel 65 and the edge position 80 of the front surface as the front-side foot width (the width K illustrated in FIG. 8) or may set the width between the base end 71 of the bevel 65 on the front surface side and the edge position 80 on the front surface side as the front-side foot width. That is, the front-side foot width used in the correction process has only to be a parameter that can define a distance between the bevel 65 and the edge position 80 of the front surface. In this embodiment, the width between the apex 70 of the bevel 65 and the edge position 80 of the front surface is set as the front-side foot width.

Figure 7:
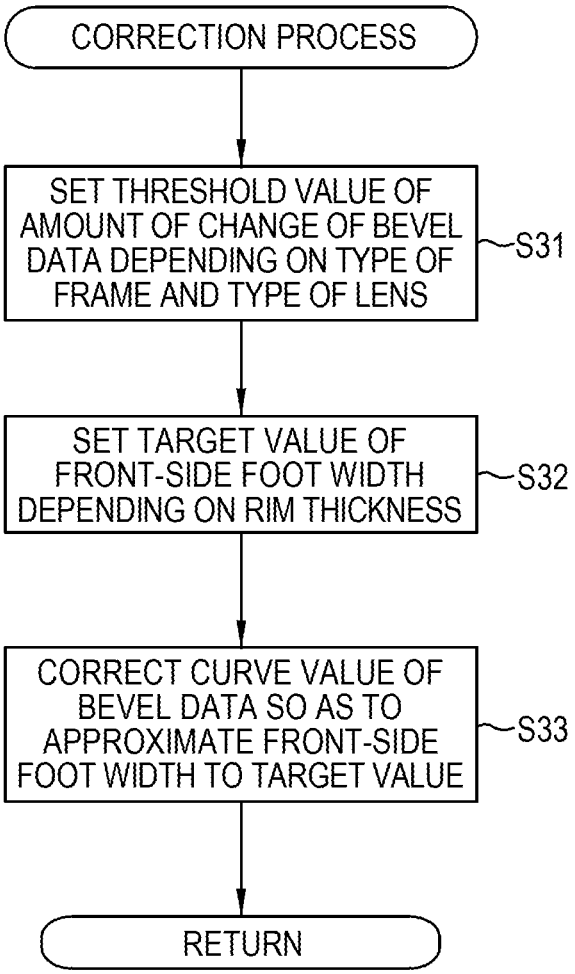
FIG. 7 is a flowchart illustrating a process flow of a correction process which is included in the bevel data generating process.

As illustrated in FIG. 7, when the correction process is started, a threshold value of an amount of change of the bevel data is set depending on the type of the frame and the type of the lens LE (S31). When a threshold value (limit) is not provided to the amount of change of the bevel data, a bevel not fitted to the frame may be formed. Therefore, the CPU 5 corrects the bevel data within a range in which the amount of change is equal to or less than the threshold value, to achieve a good balance between the appearance of the eyeglass and the fittability of the lens LE to the frame. The CPU 5 can form a more appropriate bevel in the lens LE by setting the threshold value depending on the types of the frame and the lens LE acquired in S14 (see FIG. 5).

In this embodiment, the CPU 5 corrects the bevel data by changing at least one of the curve value of the spherical component and the curve value of the cylindrical component in the temporarily-calculated bevel data. Therefore, the CPU 5 sets the threshold value of the curve value in which the change is allowable depending on the types of the frame and the lens LE in the process of S31. For example, in this embodiment, in a case where the frame is a metal frame, the threshold value D of the curve value is set to "−1.5 curve value" when the lens LE is a minus lens, and is set to "+0.5 curve value" when the lens LE is a plus lens. In a case where the frame is a plastic frame, the threshold value D of the curve value is set to "−1.0 curve value" when the lens LE is a minus lens, and is set to "0 (that is, not changed)" when the lens LE is a plus lens. The threshold value may be appropriately changed.

Subsequently, a target value of the front-side foot width is set depending on the rim thickness W of the frame (S32). The CPU 5 can generate the bevel data in which a balance between the frame and the lens is good by setting the target value depending on the rim thickness W. In this embodiment W/2 is set as the target value, but the specific method of setting the target value may be changed.

Subsequently, the curve value of the bevel data is corrected within the threshold value range so that the front-side foot width approximates the target value over the entire circumference of the lens LE (S32). Specifically, when the maximum value of the front-side foot width is greater than the target value, the CPU 5 changes at least one of the curve value of the spherical component data and the curve value of the cylindrical component data in the temporarily-calculated bevel data to approximate the maximum value to the target value. As a result, as illustrated in FIG. 8, the position 92 of the bevel 65 after the correction gets closer to the edge position 80 on the front surface side than the temporary position 91 of the bevel 65 and the maximum value of the front-side foot width W decreases. When the maximum value reaches the target value before the amount of change of the curve value exceeds the threshold value, the bevel data at the time point at which the maximum value reaches the target value is employed. When the amount of change reaches the threshold value before the maximum value reaches the target value, the bevel data at the time point at which the amount of change reaches the threshold value is employed. In this embodiment, the CPU 5 approximates the front-side foot width to the target value without changing the distortional component data of the bevel data. Therefore, the quality of the eyeglass does not degrade by an increase in distortional component. Thereafter, the process flow returns to the bevel data generating process.

As illustrated in FIG. 4, when the correction process (S3) ends, the distortional component of the groove of the frame is reflected in the bevel data (S4). Specifically, when the distortional component data is separated from the frame shape data in S22 (see FIG. 6), α% (for example, 70%) of the separated distortional component data is added to the bevel data. The value of a can be appropriately set depending on the quality of the eyeglass or the like. The value of a may be designated by the operator. In this way, the bevel data generating process based on the frame shape data and the edge position of the lens LE on the front surface side ends.

Subsequently, it is determined whether the bevel data generated in S1 to S4 is appropriate data (S6). For example, when the position of the bevel is not included in the edge thickness range of the lens LE in spite of the correction process (S3), it is determined that the bevel data is not appropriate bevel data. If the spherical component is not acquired from the frame shape data, it is determined that appropriate bevel data is not generated. When it is determined that appropriate bevel data is generated (YES in S6), the process flow ends. When it is determined that appropriate bevel data is not generated (NO in S6), the bevel data is generated using another method (S7) and the process flow ends. In S7 of this embodiment, the position of the bevel is set to a position which is obtained by dividing the edge thickness of the lens LE at a predetermined ratio.

As described above, the eyeglass lens processing apparatus 1 according to this embodiment corrects the bevel data temporarily calculated based on the frame shape data so as to approximate the front-side foot width to the target value. Therefore, the eyeglass lens processing apparatus 1 can improve the appearance of the eyeglass (particularly, the appearance on the front surface side) and can easily fit the lens LE to the frame.

Specifically, in this embodiment, the bevel data calculated based on the frame shape data is used as a basis. Therefore, it is possible to easily form a bevel which can be easily fitted to a frame in consideration of the appearance on the front surface side, compared with a case where the bevel data calculated based on the shape of the lens LE is used as a basis. For example, even when a lens LE is fitted to a non-flexible frame, a frame having a special shape, or the like, an operator can easily fit the lens LE to the frame.

The eyeglass lens processing apparatus 1 according to this embodiment approximates the maximum value of the front-side foot width over the entire circumference of the lens LE to the target value within a range in which the amount of change of the temporarily-calculated bevel data is equal to or less than the threshold value. In this case, the possibility of forming a bevel which is not fitted to the frame well is lowered. That is, the eyeglass lens processing apparatus 1 according to this embodiment can form a bevel which can cause the appearance of the eyeglass and the fittability to the frame to be compatible with each other.

In this embodiment, the threshold value of the amount of change of the bevel data is set depending on at least one of the type of the frame and the type of the lens LE. Therefore, the eyeglass lens processing apparatus 1 can form a bevel, which is suitable for at least one of the frame and the lens LE.

In this embodiment, the temporary bevel data is calculated based on at least the spherical component data of the frame. That is, when at least the spherical component data of the frame is acquired, the eyeglass lens processing apparatus 1 can generate the bevel data in which both the appearance and the fittability are good.

The eyeglass lens processing apparatus 1 according to this embodiment corrects the temporarily-set bevel data by changing at least one of the spherical component data and the cylindrical component data. In this case, the eyeglass lens processing apparatus 1 can appropriately correct the bevel data without increasing the influence of distortion.

When the distortional component data is acquired from the frame shape data, the eyeglass lens processing apparatus 1 according to this embodiment can add the acquired distortional component data to the corrected bevel data. Therefore, even when a distortional component is included in the shape of the groove of the frame, the eyeglass lens processing apparatus 1 can form a bevel, which can be easily fitted to the frame, in the lens LE.

In this embodiment, the target value of the front-side foot width is set depending on the rim thickness of the frame. That is, the eyeglass lens processing apparatus 1 can correct the bevel data toward the appropriate front-side foot width based on the rim thickness. Therefore, it is possible to generate bevel data, which can improve the appearance, through the use of an appropriate process.

The technique described in the above-mentioned embodiment can be modified in various forms. The eyeglass lens processing apparatus 1 calculates the bevel data suitable for the frame by acquiring the frame shape data and calculating the temporary bevel data based on the acquired frame shape data. However, the eyeglass lens processing apparatus 1 may calculate the temporary bevel data without acquiring the frame shape data. For example, the eyeglass lens processing apparatus 1 may acquire data of a shape of a demonstration lens which is previously formed to be fitted to the frame and may calculate the temporary bevel data based on the acquired shape data. More specifically, the eyeglass lens processing apparatus 1 may acquire the shape data of the bevel formed in the demonstration lens. Curve data of the lens surface of the demonstration lens may be acquired as shape data and the temporary bevel data may be calculated based on the acquired curve data. Since the demonstration lens is formed to be fitted to the frame, the temporary bevel data which is fitted to the frame can be appropriately calculated using the shape data of the demonstration lens. Various methods can be employed to acquire the curve data of the demonstration lens. For example, an operator may manually measure the curve value of the demonstration lens using a curve meter and may input the measured curve value to the eyeglass lens processing apparatus 1 through the use of the operation unit 50 or the like. The eyeglass lens processing apparatus 1 may trace the shape of the demonstration lens in a state where the demonstration lens is mounted on the lens chuck shafts 16L and 16R.

The above-mentioned embodiment exemplifies the process of forming a bevel in a lens LE. However, if a groove for fitting a lens LE to a frame is formed in the lens LE as described above, the technique described in the above-mentioned embodiment can also be applied. In this case, the process performed on the bevel in the above-mentioned embodiment can be replaced with the process performed on the groove. For example, in S11, the CPU 5 may acquire curve data of a demonstration lens and may acquire data of the groove (that is, groove suitable for the frame) formed in the demonstration lens from the curve data. In this case, in S23, S25, and S27, temporary data of the groove to be formed in the lens LE can be calculated based on the data of the groove formed in the demonstration lens. In S33, the temporarily-calculated data of the groove can be corrected so as to approximate the width (front-side foot width) between the groove to be formed and the edge position on the front surface side to a target value. If a protrusion formed in the frame is fitted into a groove formed in the lens LE, shape data of the protrusion formed in the rim of the frame may be acquired as the frame shape data in the information acquired process (see FIG. 5).

In the above-mentioned embodiment, the eyeglass lens processing apparatus 1 generates the bevel data and forms the bevel in the lens LE based on the generated bevel data. However, a device other than the eyeglass lens processing apparatus 1 may generate the bevel data or the groove data. For example, a CPU of a PC may execute the processing control data generating program described in the above-mentioned embodiment and may generate the bevel data. In this case, the eyeglass lens processing apparatus 1 can acquire the bevel data generated by the PC and can form the bevel based on the acquired bevel data. As described above, the generating device that generates the bevel data or the groove data is not limited to the eyeglass lens processing apparatus 1.

The eyeglass lens processing apparatus 1 according to the above-mentioned embodiment acquires both the edge position on the front surface side of the lens LE and the edge position on the rear surface side and generates the bevel data based on the acquired positions. However, the eyeglass lens processing apparatus 1 may acquire only the edge position on the front surface side of the lens LE and may generate the bevel data or the groove data. In this case, the eyeglass lens processing apparatus 1 can also improve the appearance of the eyeglass on the front surface side.

The eyeglass lens processing apparatus 1 according to the above-mentioned embodiment sets the threshold value of the amount of change of the temporarily-generated bevel data depending on the material of the frame and the shape of the lens LE. Therefore, a suitable bevel based on the frame and the lens LE can be formed. However, the method of setting the threshold value may be changed. For example, the threshold value may be set depending on the shape of the frame. The threshold value may be set depending on the material of the lens LE. The threshold value may be changed depending on any one of the type of the frame and the type of the lens LE. A fixed threshold value may be used.

The distortional component included in the shapes of the left and right rims may not be symmetrical due to an influence of a manufacturing error or the like. When the distortional component is reflected in the bevel data or the groove data in S4 of FIG. 4 or S23 of FIG. 6, it is preferable that the eyeglass lens processing apparatus 1 separately acquire the frame shape data of the left rim and the frame shape data of the right rim and separately generate the left and right bevel data. In this case, the eyeglass lens processing apparatus 1 can form a bevel or a groove more suitable for the frame, compared with a case where one of the left and right data is inverted to generate the other data. The eyeglass lens processing apparatus 1 may generate data without reflecting the distortional component in S4 or S23.

The eyeglass lens processing apparatus 1 according to the above-mentioned embodiment can easily generate the bevel data suitable for the rim thickness by setting the target value of the front-side foot width depending on the rim thickness of the frame. However, even when the target value of the front-side foot width is fixed, the technique described in the above-mentioned embodiment can be implemented. The degree of improvement of the appearance by the technique exemplified in the above-mentioned embodiment is larger when a minus lens is processed than when the other types of lenses are processed. Therefore, the eyeglass lens processing apparatus 1 may apply the technique exemplified in the above-mentioned embodiment when a minus lens is processed, and may generate data using another algorithm when another type of lens is processed.

What is claimed is:

1. An eyeglass lens processing apparatus comprising:

a processing unit configured to form, on a peripheral edge of a lens, a bevel or a groove for fitting the lens to a frame of an eyeglass;

a processor; and memory storing computer readable instructions, when executed by the processor, causing the eyeglass lens processing apparatus to:

calculate data of the bevel or the groove to be formed on the peripheral edge of the lens based on frame shape data of the frame or demonstration lens shape data which is shape data of a demonstration lens having the bevel or the groove fitted to the shape of the frame; and approximate a front-side foot width, which is a width between a position of the bevel or the groove to be formed on the lens and a position of a front edge of the lens, to a target value by correcting the calculated data of the bevel or the groove;

wherein the computer readable instructions, when executed by the processor, causes the eyeglass lens processing apparatus to acquire at least one of spherical component data, cylindrical component data, and distortional component data based on the shape of the frame or the demonstration lens; and wherein the computer readable instructions, when executed by the processor, causes the eyeglass lens processing apparatus to reflect distortional component data in the corrected data of the bevel or the groove.

2. The eyeglass lens processing apparatus according to claim 1, wherein the computer readable instructions, when executed by the processor, causes the eyeglass lens processing apparatus to approximate a maximum value of the front-side foot width to the target value within a range in which an amount of change of the calculated data of the bevel or the groove is equal to or less than a threshold value.

3. The eyeglass lens processing apparatus according to claim 2, wherein the threshold value is set based on at least one of a type of the frame and a type of the lens.

4. The eyeglass lens processing apparatus according to claim 1, wherein the computer readable instructions, when executed by the processor, causes the eyeglass lens processing apparatus to calculate the data of the bevel or the groove based on at least the spherical component data acquired by the shape data acquiring means.

5. The eyeglass lens processing apparatus according to claim 1, wherein the computer readable instructions, when executed by the processor, causes the eyeglass lens processing apparatus to correct the data of the bevel or the groove by changing at least one of spherical component data and cylindrical component data.

6. The eyeglass lens processing apparatus according to claim 1, wherein the target value is set based on a rim thickness of the frame.

7. A non-transitory computer readable recording medium storing a program for generating data for controlling an operation of an eyeglass lens processing apparatus configured to, on a peripheral edge of a lens, a bevel or a groove for fitting the lens to a frame of an eyeglass, the program including computer readable instructions, when executed by a processor of a generating device, causing the generating device to:

calculate data of the bevel or the groove to be formed on a peripheral edge of the lens based on frame shape data of the frame or demonstration lens shape data which is shape data of a demonstration lens having the bevel or the groove fitted to the shape of the frame; and approximate a front-side foot width, which is a width between a position of the bevel or the groove and a position of a front edge of the lens, to a target value by correcting the calculated data of the bevel or the groove;

wherein the computer readable instructions, when executed by the processor, causes the eyeglass lens processing apparatus to acquire at least one of spherical component data, cylindrical component data, and distortional component data based on the shape of the frame or the demonstration lens; and wherein the computer readable instructions, when executed by the processor, causes the eyeglass lens processing apparatus to reflect distortional component data in the corrected data of the bevel or the groove.

8. A method for generating data for controlling an operation of an eyeglass lens processing apparatus configured to, on a peripheral edge of a lens, a bevel or a groove for fitting the lens to a frame of an eyeglass, the method comprising:

calculating data of the bevel or the groove to be formed on the peripheral edge of the lens based on frame shape data of the frame or demonstration lens shape data which is shape data of a demonstration lens having the bevel or the groove fitted to the shape of the frame; and approximating a front-side foot width, which is a width between a position of the bevel or the groove and a position of a front edge of the lens, to a target value by correcting the calculated data of the bevel or the groove;

acquiring at least one of spherical component data, cylindrical component data, and distortional component data based on the shape of the frame or the demonstration lens; and reflecting distortional component data in the corrected data of the bevel or the groove.

9. An eyeglass lens processing apparatus comprising:

a processing unit configured to form, on a peripheral edge of a lens, a bevel or a groove for fitting the lens to a frame of an eyeglass;

a processor; and memory storing computer readable instructions, when executed by the processor, causing the eyeglass lens processing apparatus to:

calculate data of the bevel or the groove to be formed on the peripheral edge of the lens based on frame shape data of the frame or demonstration lens shape data which is shape data of a demonstration lens having the bevel or the groove fitted to the shape of the frame; and acquire cylindrical component data based on the frame shape data of the frame or the demonstration lens shape data;

change the acquired cylindrical component data;

correct the calculated data of the bevel or the groove based on the changed cylindrical component data; and approximate a front-side foot width, which is a width between a position of the bevel or the groove to be formed on the lens and a position of a front edge of the lens, to a target value based on the corrected data of the bevel or the groove.

* * * * *